US008808065B2

(12) United States Patent
Weder

(10) Patent No.: US 8,808,065 B2
(45) Date of Patent: Aug. 19, 2014

(54) SURFACE TREATING DEVICE

(75) Inventor: James Weder, Kent, WA (US)

(73) Assignee: Design Technologies LLC, Bellevue, WA (US)

( * ) Notice: Subject to any disclaimer, the term of this patent is extended or adjusted under 35 U.S.C. 154(b) by 243 days.

(21) Appl. No.: 13/529,403

(22) Filed: Jun. 21, 2012

(65) Prior Publication Data

US 2013/0344785 A1 Dec. 26, 2013

(51) Int. Cl.
*B24B 11/00* (2006.01)

(52) U.S. Cl.
USPC ..... 451/529; 451/350; 451/357; 451/536; 451/537; 15/230

(58) Field of Classification Search
CPC .... B24B 7/186; B24B 41/047; B24B 55/102; A47L 11/4069; A47L 11/4038; B24D 11/00; B24D 11/005; B24D 13/14; B24D 7/04; B24D 9/08
USPC ..... 451/464–469, 350, 353, 529, 536, 537
See application file for complete search history.

(56) References Cited

U.S. PATENT DOCUMENTS

| | | | | | |
|---|---|---|---|---|---|
| 2,958,593 | A * | 11/1960 | Hoover et al. | 51/295 |
| 3,688,453 | A * | 9/1972 | Legacy et al. | 451/532 |
| 3,703,739 | A * | 11/1972 | Young et al. | 15/230.17 |
| 3,795,932 | A * | 3/1974 | Young | 15/98 |
| 4,331,453 | A * | 5/1982 | Dau et al. | 51/298 |
| 4,609,581 | A * | 9/1986 | Ott | 428/100 |
| 4,731,125 | A * | 3/1988 | Carr | 134/7 |
| 4,893,439 | A * | 1/1990 | McAvoy et al. | 451/532 |
| 4,933,231 | A * | 6/1990 | Seber | 442/148 |
| 5,482,756 | A * | 1/1996 | Berger et al. | 428/36.2 |
| 5,667,842 | A * | 9/1997 | Larson et al. | 427/258 |
| 5,919,549 | A * | 7/1999 | Van et al. | 428/141 |
| 5,928,070 | A * | 7/1999 | Lux | 451/526 |
| 6,281,149 | B1 * | 8/2001 | Hussein et al. | 442/239 |
| 6,786,812 | B2 * | 9/2004 | Stuckenholz et al. | 451/490 |
| 6,971,950 | B2 * | 12/2005 | Dudovicz | 451/307 |
| 7,134,953 | B2 * | 11/2006 | Reinke | 451/530 |
| 7,628,829 | B2 * | 12/2009 | Woo et al. | 51/295 |
| 2007/0204518 | A1 * | 9/2007 | Hibbard | 51/297 |
| 2007/0243804 | A1 * | 10/2007 | Peterson | 451/534 |
| 2009/0215362 | A1 * | 8/2009 | Thysell | 451/41 |

* cited by examiner

*Primary Examiner* — George Nguyen

(74) *Attorney, Agent, or Firm* — Young & Thompson

(57) ABSTRACT

A surface treating device includes an open lofty non-woven layer (1) and a woven layer (2). The non-woven layer and woven layer have facing sides (5, 6) which are adhered to each other. A plurality of abrasive segments (3) is adhered to the woven layer on the side (7) of the woven layer (2) which faces away from the non-woven layer (1). Thus, the abrasive segments are held in a stable manner so as to better withstand the frictional forces exerted thereon during service.

13 Claims, 3 Drawing Sheets

SURFACE TREATING DEVICE

BACKGROUND OF THE INVENTION

The invention is related to the field of surface treating devices. Such devices are applied for various purposes, such as grinding, burnishing or polishing and the like. To that end, the surface treating devices comprise abrasive particles. The device is mounted onto the holder of a treatment machine, and is for instance be rotated over the surface in question. Usually, the surface treating devices also comprise a flexible and somewhat compressible material which allows the treatment surface to exert a regular pressure on the surface, also in case uneven areas are to be treated. This compressible material may take the form of an open lofty non-woven web of fibers. The fibers are entangled in each other and provide a structure which relatively large open spaces or pores which provide the required flexibility and compressibility.

By means of such a surface treating device, stone or stone-like surfaces can be treated, although other applications exist as well such as the treatment of wooden or plastic surfaces. The surfaces in question can be floor surfaces, such as marble, granite or terrazzo and the like which are applied in large areas such as hotel lobbies and shopping centers. Nevertheless, also wall surfaces can be treated. In particular in cases where large areas have to be treated, the surface treating devices are used in the form of circular pads which are mounted to the rotating discs of a floor treatment machine. During the surface treating process, the floor treatment device is subjected to frictional forces which may generate temperature increases. The longer this process is maintained, and/or the higher the friction forces generated, the floor treating device will wear down at a certain speed.

It appears that the loadings to which the floor treatment devices are subjected may lead to a disintegration of the non-woven layer. Parts thereof are torn loose from the main body, resulting in a poor and instable behavior. This often leads to premature discarding of the surface treating device, although an appreciable remainder of the surface treating device may still be in a good condition for carrying out the treatment in question. However, the fact that parts of the surface treating device are lost during the process makes it useless.

SUMMARY OF THE INVENTION

The object of the invention is therefore to provide a surface treating device which is better resistant to the detrimental influences which make that the integrity thereof is prematurely lost. This object is achieved by means of a surface treating device, comprising an open lofty non-woven layer and a woven layer, said non-woven layer and woven layer having facing sides which are adhered to each other, as well as a plurality abrasive segments adhered to the woven layer on the side of said woven layer which faces away from the non-woven layer.

In the surface treating device according to the invention, the abrasive segments are adhered to the woven layer. Such woven layer can, by definition, have a high strength and in-plane stiffness within the plane defined by this layer. Furthermore, the woven layer generally has a high bending flexibility. Thus, the frictional forces which are exerted upon the abrasive segments, resulting from the movement of these segments over the surface to be treated, can very well be taken by the woven layer. Due to the fact that the frictional forces are generally parallel to the woven layer, this layer will exhibit only relatively small deformations within its plane. In comparison, in the traditional surface treating devices, the abrasive segments are directly adhered to the non-woven layer. The resistance against in-plane deformations of such rather flexible non-woven material is low, having regard to the fact that it must provide a certain adaptability of the device with respect to unevenness of the surface. This results in relatively high in-plane deformations and therefore high risks of damage such as tearing. In contrast, as a result of the high resistance of the woven layer against in-plane deformations and tearing, the integrity of the surface treating device according to the invention will be maintained for much longer periods and even under heavier loadings. As noted before, the woven layer has a high bending flexibility, whereby the woven layer and the abrasive elements are still allowed to adapt to uneven surfaces. Also, compression deformations of the non-woven layer are still possible, despite the high in-plane stiffness of the woven layer.

A further advantage of the surface treating device according to the invention is the possibility to apply heat resistant fibers in the woven material. When moving the abrasive members over the floor surface, heat will inevitably be generated. During prolonged periods of use, the temperature of the surface treating device will rise appreciably. In the traditional surface treating devices, the bond of the abrasive particles and the non-woven layer will thereby deteriorate rapidly, resulting in loss of integrity and abrasive segments breaking away. Also, the plastic fibers of the non-woven material are vulnerable with respect to high temperatures. Eventually, such fibers will melt, resulting in an aggravated integrity loss. In contrast, the abrasive segments adhered to the woven material will during prolonged periods, also in the case of temperature increases. The vulnerable fibers of the non-woven layer are protected, as the woven layer may act as a heat shield. The fibers of the woven material may be selected with a view on these circumstances, thus ensuring a better longevity.

The abrasive segments may be carried out in different ways; preferably the abrasive segments comprise a plastic matrix material as well as abrasive particles dispersed in the plastic matrix material. Such abrasive particles may for instance comprise boron, cubic nitride or diamond.

The plastic matrix material is adhered to the woven material by engagement of said plastic matrix material in the pores between the weft and warp threads of the woven material. Thereby, a strong bond is ensured between the abrasive segments and the woven material, preventing breakaway of the segments from the woven material. In order to ensure a high resistance against tearing the woven layer may comprise high-strength fibers, such as Kevlar© fibers.

The surface treating device may be carried out in several forms, such as in the form of a belt, Preferably however, the device is flat and comprises a circular circumference, wherein the abrasive segments are regularly distributed in circumferential direction. Furthermore, the non-woven layer may have a mounting side which faces away from the woven layer, for mounting onto a treatment tool, such as a polisher or grinder. Said mounting side may comprise fastening means, such hook and/or loop fastening means.

The abrasive segments can be obtained by pouring a flowable mixture of plastic material and abrasive particles onto the woven layer and subsequently curing said mixture.

The invention will now further be described with reference to the embodiment shown in the figures.

Figure 1:
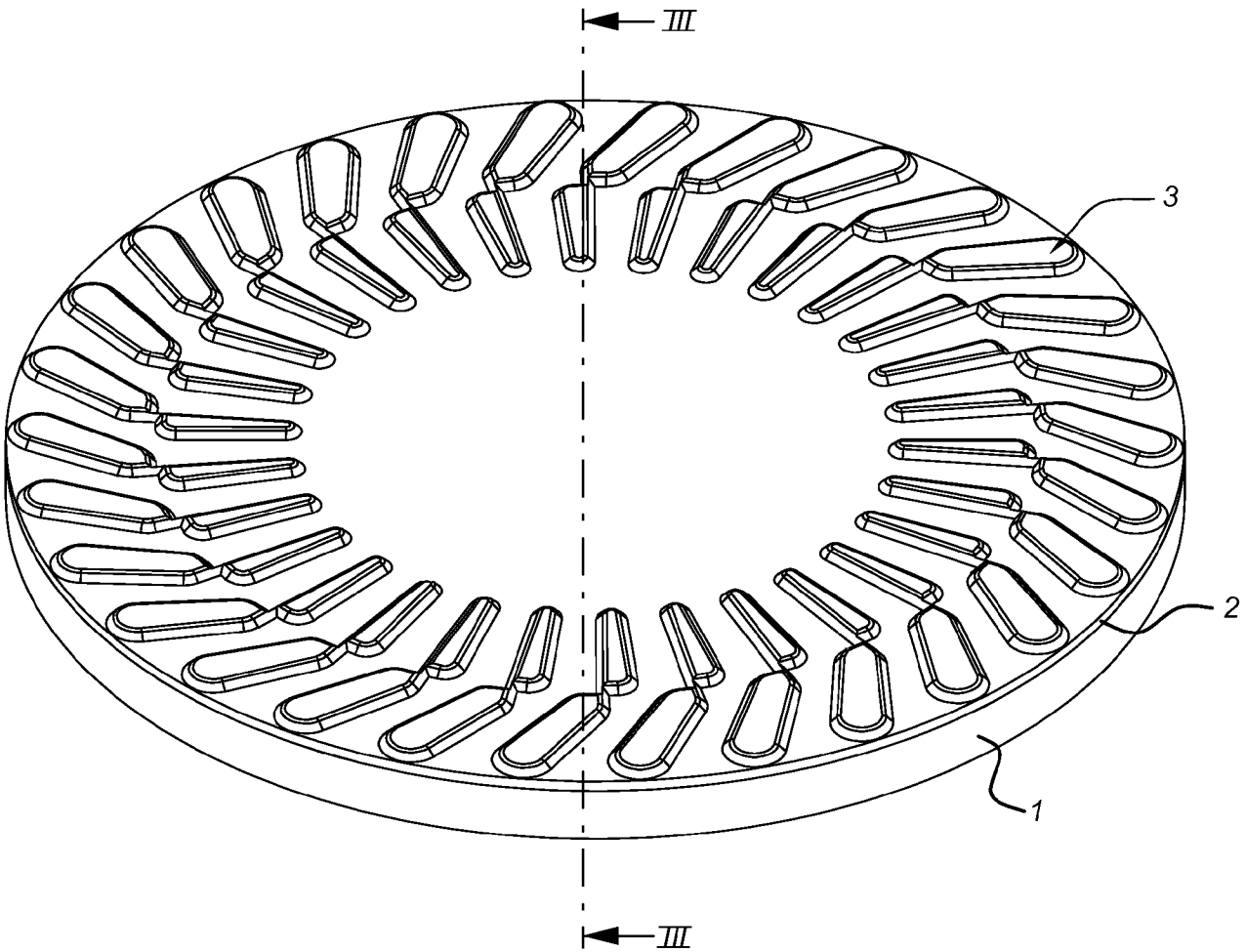
FIG. 1 shows a view in perspective of a surface treating device in the form of a circular pad.
Figure 2:
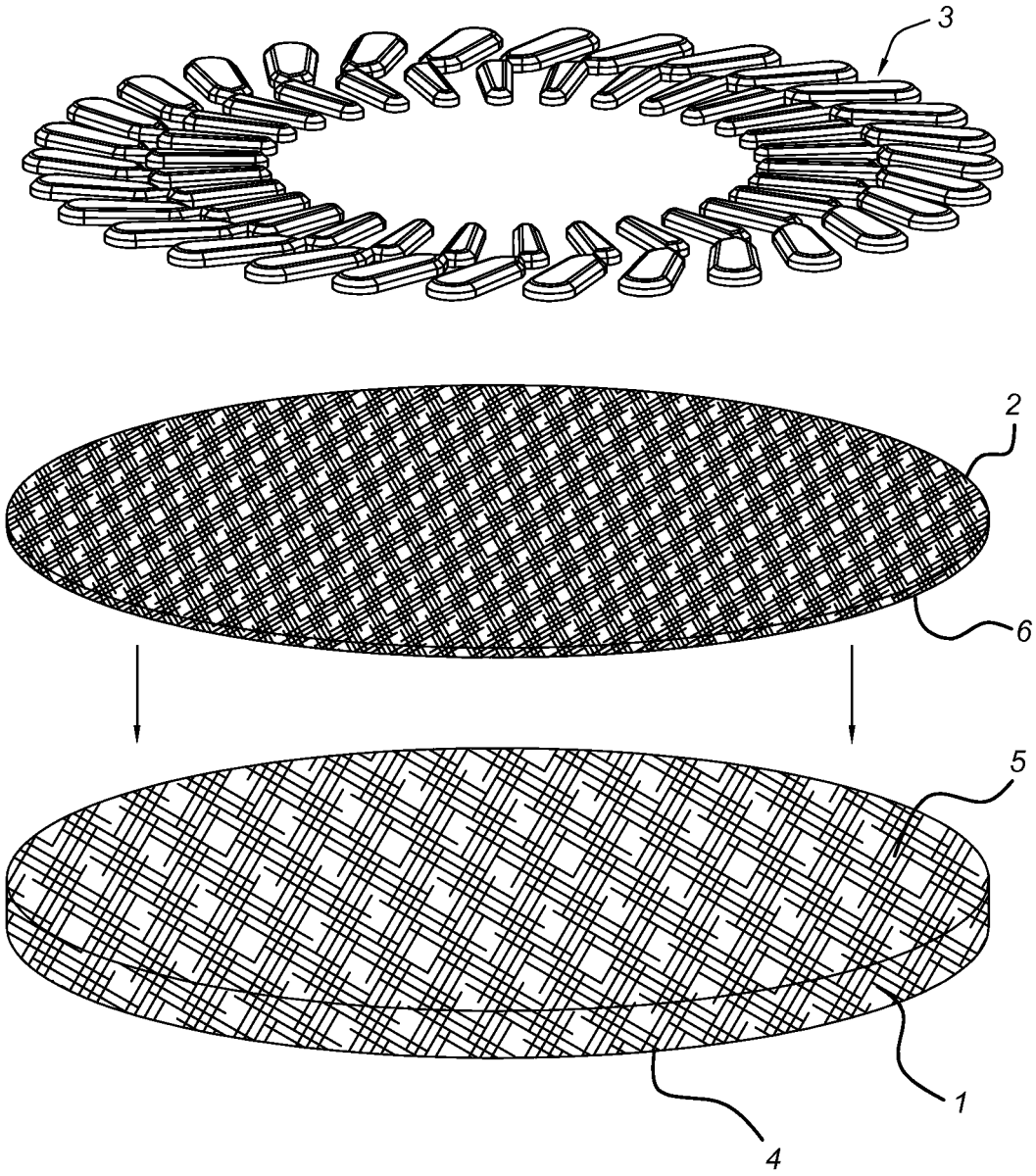
FIG. 2 shows the components of the pad in exploded view.
Figure 3:
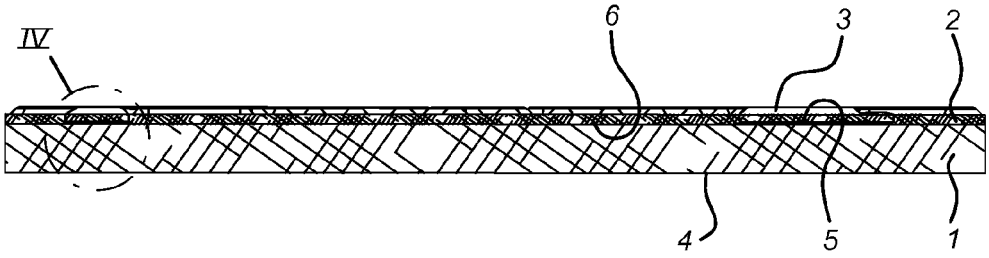
FIG. 3 shows the cross section according to III-III of FIG. 1.
Figure 4:
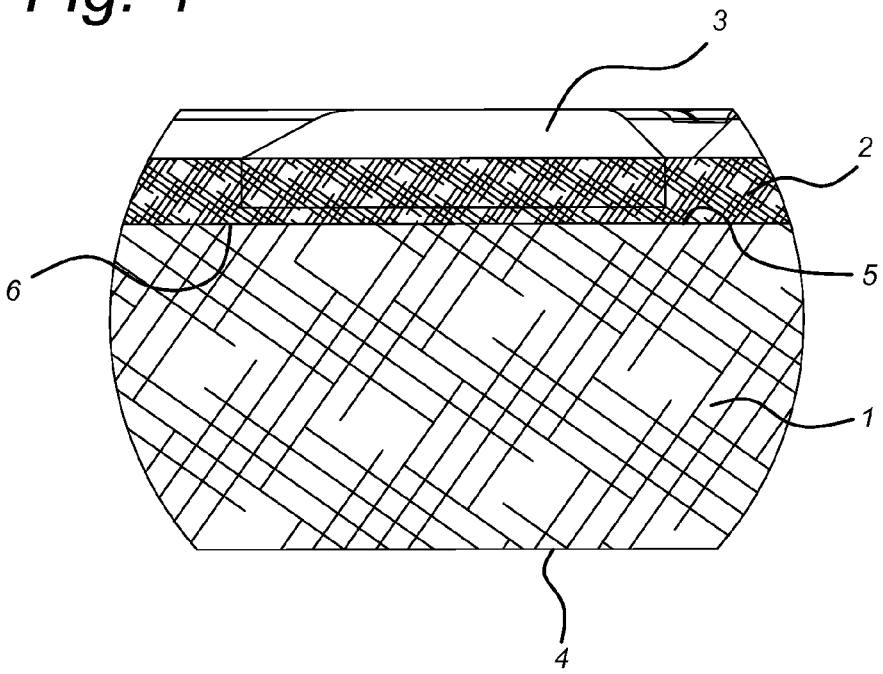
FIG. 4 shows the detail of FIG. 3 on a larger scale.

The abrasive pad as shown in FIG. 1 comprises a non-woven layer 1 of plastic fibers which are randomly entangled in each other, which is known per se. This non-woven layer 1 has a mounting side 4 for mounting the pad onto the rotational disc of a floor treatment apparatus (not shown). Onto the other side 5 of the non-woven layer, opposite the mounting side 4, the facing side 6 of a woven layer 2 is adhered.

Preferably, this achieved by means of a heat resistant adhesive so as to withstand the relatively high temperatures which may occur during service. Onto the other, free side 7 of the woven layer 2, a pattern of abrasive segments 3 is poured. The still flowable material of these segments conforms to the shapes of the fibers in the free side 7 of the woven layer 2, and may penetrate in the voids between said fibers. After solidification of the material of these segments 3, they are firmly adhered to the woven layer 2.

The material of the abrasive segments may consist, in a known way, from a mixture of plastic matrix material, such as resin, and abrasive particles dispersed throughout the plastic matrix material.

LIST OF REFERENCE NUMERALS

1. Non-woven layer
2. Woven layer
3. Abrasive segment
4., 5. Side of non-woven layer
6., 7. Side of woven layer

The invention claimed is:

1. Surface treating device, comprising an open lofty non-woven layer (1) and a woven layer (2), said non-woven layer and woven layer having facing sides (5, 6) which are adhered to each other, as well as a plurality abrasive segments (3) adhered to the woven layer on the side (7) of said woven layer (2) which faces away from the non-woven layer (1).

2. Surface treating device according to claim 1, wherein the abrasive segments (3) comprise a plastic matrix material as well as abrasive particles dispersed in the plastic matrix material.

3. Surface treating device according to claim 2, wherein the abrasive particles (3) comprise boron, cubic nitride or diamond.

4. Surface treating device according to claim 2, wherein the plastic matrix material of the abrasive segments (3) is adhered to the woven material (2) by engagement of said plastic matrix material in the pores or voids between the weft and warp threads of the woven material.

5. Surface treating device according to claim 1, wherein the woven layer (2) comprises high-strength fibers, such as Kevlar© fibers.

6. Surface treating device according to claim 1 comprising a circular circumference, wherein the abrasive segments (3) are regularly distributed in circumferential direction.

7. Surface treating device according to claim 1, wherein said non-woven layer (1) has a mounting side (4) which faces away from the woven layer (2), for mounting onto a treatment tool, such as a polisher or grinder.

8. Surface treating device according to claim 7, wherein the mounting side (4) of the non-woven layer (1) comprises fastening means, such hook and/or loop fastening means.

9. Surface treating device according to claim 1, wherein the abrasive segments (3) are obtained by pouring a flowable mixture of plastic material and abrasive particles onto the woven layer (2) and subsequently curing said mixture.

10. Surface treating device according to claim 3, wherein the plastic matrix material of the abrasive segments (3) is adhered to the woven material (2) by engagement of said plastic matrix material in the pores or voids between the weft and warp threads of the woven material.

11. Surface treating device according to claim 2, wherein the woven layer (2) comprises high-strength fibers, such as Kevlar© fibers.

12. Surface treating device according to claim 2 comprising a circular circumference, wherein the abrasive segments (3) are regularly distributed in circumferential direction.

13. Surface treating device according to claim 2, wherein said non-woven layer (1) has a mounting side (4) which faces away from the woven layer (2), for mounting onto a treatment tool, such as a polisher or grinder.

* * * * *